US008770710B2

(12) United States Patent
Kawakami

(10) Patent No.: US 8,770,710 B2
(45) **Date of Patent: *Jul. 8, 2014**

(54) FLUID EJECTING APPARATUS

(75) Inventor: Takayuki Kawakami, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 133 days.

This patent is subject to a terminal disclaimer.

(21) Appl. No.: 12/975,598

(22) Filed: Dec. 22, 2010

(65) Prior Publication Data

US 2011/0157287 A1 Jun. 30, 2011

(30) Foreign Application Priority Data

Dec. 25, 2009 (JP) ..... 2009-295640

(51) Int. Cl.
*B41J 2/165* (2006.01)

(52) U.S. Cl.
CPC ..... *B41J 2/16526* (2013.01); *B41J 2/16585* (2013.01)
USPC ..... 347/31; 347/35

(58) Field of Classification Search
CPC ..... B41J 2/16526
USPC ..... 347/104, 31, 35
See application file for complete search history.

(56) References Cited

U.S. PATENT DOCUMENTS 5,557,306 A * 9/1996 Fukushima et al. ..... 347/33
5,557,307 A * 9/1996 Paroff ..... 347/34
5,790,146 A * 8/1998 Anderson ..... 347/28
5,847,674 A * 12/1998 Paroff et al. ..... 347/33
6,189,989 B1 * 2/2001 Hirabayashi et al. ..... 347/4
6,578,945 B2 6/2003 Hashi et al.
7,401,885 B2 7/2008 Yamazaki et al.
7,562,961 B2 7/2009 Inoue
2005/0078145 A1 * 4/2005 Inoue ..... 347/31
2009/0002435 A1 1/2009 Roh et al.
2010/0118084 A1 5/2010 Seshimo
2011/0080447 A1 * 4/2011 Seshimo ..... 347/31

FOREIGN PATENT DOCUMENTS

CN 101332711 12/2008
JP 2005-119284 5/2005

OTHER PUBLICATIONS

U.S. Appl. No. 12/898,786, Apr. 16, 2012, Restriction Requirement.
U.S. Appl. No. 12/898,786, Jun. 22, 2012, Office Action.
U.S. Appl. No. 12/898,786, Sep. 27, 2012, Final Office Action.

* cited by examiner

*Primary Examiner* — Manish S Shah
*Assistant Examiner* — Jeffrey C Morgan
(74) *Attorney, Agent, or Firm* — Workman Nydegger

(57) ABSTRACT

Provided is a fluid ejecting apparatus including: a fluid ejecting head; a receiving member which is linear; a support member which supports the receiving member so as to extend in a linear shape; a support member movement unit which moves the support member between first and second positions so that the receiving member is located at a receiving position capable of receiving the fluid ejected from the nozzles at the first position, and the receiving member is located at a retreat position deviating from the receiving position at the second position; and a contact member which comes into contact with the receiving member while moving in a direction intersecting the extension direction of the receiving member relative to the receiving member when the support member movement unit moves the support member from the second position to the first position.

10 Claims, 6 Drawing Sheets

FLUID EJECTING APPARATUS

BACKGROUND

1. Technical Field

The present invention relates to a fluid ejecting apparatus such as an ink jet printer.

2. Related Art

In general, an ink jet printer (hereinafter, simply referred to as a "printer") has been known as a fluid ejecting apparatus that ejects a fluid from a nozzle formed on a fluid ejecting head toward a target. In the printer, if ink (fluid) is not ejected for some time from a specific nozzle during a printing process, the ink in the nozzle is thickened or solidified, dust attaches to the nozzle, or bubbles become mixed with the ink in the nozzle, which may cause an erroneous ejecting of the ink. Therefore, generally, the printer performs a flushing process in which the ink is ejected from the nozzle on the basis of a control signal not involved with the printing process.

That is, for example, in a serial type printer designed to perform a printing process while a printing head scans the primary scanning direction, the flushing process is performed in such a manner that the printing head moves to a position deviating from the printing area and the ink is ejected toward a flushing box directly disposed below the printing head. Further, in a line head type printer designed to use a large printing head corresponding to the width of the printing sheet, JP-A-2005-119284 discloses a configuration in which an absorbing member (a receiving member) is provided in a transportation belt used to transport a printing sheet and the ink is ejected to the absorbing member.

However, in the case of the printer disclosed in JP-A-2005-119284, the absorbing member needs to directly face the nozzle during the flushing process. For this reason, the flushing process cannot be performed when the printing process is performed on an elongated sheet such as a continuous sheet. Further, since the ink needs to be ejected to the absorbing member at a timing at which the absorbing member is transported between the printing sheets and faces the printing head, a problem arises in that the constraints on the size or the transportation speed of the printing sheet occur. Furthermore, since the flushing process is performed on the planar absorbing member in the printer disclosed in JP-A-2005-119284, mist-like ink scatters due to wind pressure accompanying the ejection of the ink, which causes concerns that the inside of the printer may be contaminated.

Therefore, a method has been proposed in which a linear absorbing member moves within an empty area formed between a printing sheet and the printing head to face a nozzle, and ink is ejected from the nozzle to the absorbing member stopped in the facing position, where the flushing process is performed intermittently within a short period of time.

However, when the absorbing member is formed in a linear shape, the area capable of absorbing the ink in the absorbing member decreases more than that of the planar absorbing member. In addition, when the linear absorbing member moving within the empty area formed between the printing sheet and the printing head stops at the position facing the nozzle, the linear absorbing member may be easily vibrated compared with the planar absorbing member.

For this reason, when the absorbing member is formed in a linear shape, since the absorbing member is vibrated, the absorbing member may deviate from the area capable of absorbing the ink in the absorbing member, which raises concerns that the inside of the printer may be contaminated.

SUMMARY

An advantage of some aspects of the invention is that it provides a fluid ejecting apparatus capable of rapidly and easily receiving a fluid ejected from a nozzle to a receiving member even when the linear receiving member moves and stops at a position capable of receiving the fluid ejected from the nozzle.

According to an aspect of the invention, there is provided a fluid ejecting apparatus including: a fluid ejecting head which includes nozzles ejecting a fluid; a linear receiving member which is capable of receiving the fluid ejected from the nozzles; a support member which supports the receiving member so as to extend in a linear shape; a support member movement unit which moves the support member between first and second positions so that the receiving member is located at a receiving position capable of receiving the fluid ejected from the nozzles at the first position, and the receiving member is located at a retreat position deviating from the receiving position at the second position; and a contact member which comes into contact with the receiving member while moving in a direction intersecting the extension direction of the receiving member relative to the receiving member supported by the support member to extend in a linear shape, wherein the contact member comes into contact with the receiving member when the support member movement unit moves the support member from the second position to the first position.

When the support member moving from the second position to the first position stops at the first position, the linear receiving member supported by the support member may be vibrated at the receiving position due to the restoration force of the receiving member and the inertia force in the movement direction. For this reason, according to this configuration, when the receiving member moves to the receiving position in accordance with the movement of the support member from the second position to the first position, the receiving member comes into contact with the contact member, thereby suppressing the vibration of the receiving member at the receiving position. Accordingly, even when the linear receiving member moves and stops at the receiving position capable of receiving the fluid ejected from the nozzles, it is possible to rapidly and easily receive the fluid ejected from the nozzles by the use of the receiving member.

In the fluid ejecting apparatus of the aspect, the distance between the receiving position and the contact position in which the receiving member comes into contact with the contact member is shorter than the distance between the retreat position and the contact position.

The vibration of the receiving member is large when the receiving member moves fast compared with the case where the receiving member moves slowly. For this reason, according to this configuration, even when the receiving member moves fast over the long distance from the retreat position to the contact position, since the receiving member comes into contact with the other members at the contact position, it is possible to suppress the vibration thereof. Accordingly, it is possible to rapidly move the receiving member from the retreat position to the first receiving position while suppressing vibration of the receiving member.

In the fluid ejecting apparatus of the aspect, the contact member comes into contact with the receiving member at least one of before and after the receiving member reaches the receiving position.

According to this configuration, when the receiving member comes into contact with the contact member before reaching the receiving position, it is possible to allow the receiving member to reach the receiving position while suppressing the vibration of the receiving member. In addition, when the receiving member comes into contact with the contact member after reaching the receiving position, it is possible to attenuate the vibration of the receiving member located at the receiving position. Accordingly, it is possible to rapidly eject the fluid toward the receiving member reaching the receiving position.

In the fluid ejecting apparatus of the aspect, the contact member is formed as at least one of a fixation member which is immovably fixed in the movement direction relative to the receiving member and a movable member which is movably disposed in the movement direction. When the contact member is formed as the fixation member, the fluid ejecting apparatus further includes a movement direction changing unit which changes the movement direction of the receiving member toward the fixation member while the receiving member moves from the retreat position toward the receiving position.

According to this configuration, even when the movement direction of the receiving member is changed by the movement direction changing unit so that the receiving member comes into contact with the contact member including the fixation member, or even when the contact member including the movable member moves so as to come into contact with the receiving member, it is possible to suppress the vibration of the receiving member.

In the fluid ejecting apparatus of the aspect, the movement direction changing unit includes a slope surface which intersects a movement path of the receiving member.

According to this configuration, when the support member moves, the movement direction of the receiving member changes along the slope surface. For this reason, it is possible to allow the receiving member to come into contact with the contact member by easily changing the movement direction of the receiving member.

In the fluid ejecting apparatus of the aspect, the contact member comes into contact with the receiving member at the receiving position.

According to this configuration, since the contact member is able to come into contact with the receiving member stopping at the receiving position, it is possible to attenuate the vibration of the receiving member.

In the fluid ejecting apparatus of the aspect, the contact member is the movable member which provided so as to protrude upward and downward in the movement path of the receiving member.

According to this configuration, since the contact member including the movable member moves so as to protrude upward and downward in the movement path of the receiving member, it is possible to suppress the vibration of the receiving member by allowing the receiving member to come into contact with the contact member. Further, when the receiving member receiving the fluid at the receiving position moves to the retreat position, since the contact member moves to a position not intersecting the movement path of the receiving member, the contact between the receiving member and the contact member is suppressed, which may reduce concerns that the fluid may become attached to the contact member.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment will be described with reference to the accompanying drawings, in which a fluid ejecting apparatus of the invention is embodied as an ink jet printer. Further, in the description below, the "longitudinal direction", the "horizontal direction", and the "vertical direction" respectively indicate the longitudinal direction, the horizontal direction, and the vertical direction depicted by the arrows in FIGS. 1 and 2.

Figure 1:
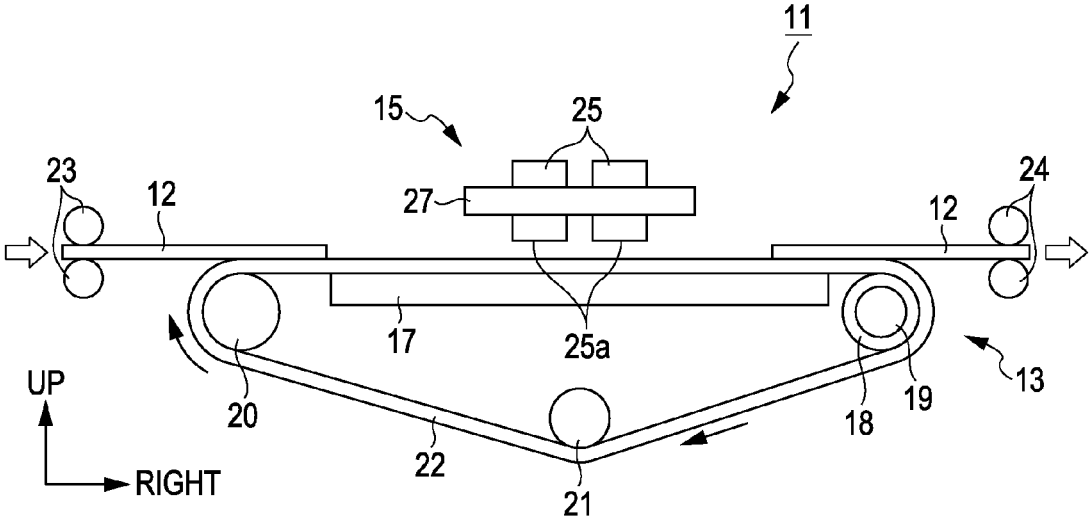
FIG. 1 is a front schematic diagram illustrating a printer of an embodiment.

As shown in FIG. 1, an ink jet printer (hereinafter, referred to as a "printer") 11 as a fluid ejecting apparatus includes a transportation unit 13 which transports a printing sheet 12 and a printing head unit 15 which performs a printing process on the printing sheet 12.

The transportation unit 13 includes a platen 17 which is formed as an elongated rectangular plate shape in the horizontal direction. A driving roller 18 extending in the longitudinal direction is disposed on the right side of the platen 17 so as to be rotationally driven by a driving motor 19, and a driven roller 20 extending in the longitudinal direction is disposed on the left side of the platen 17 so as to be rotatable. Further, a tension roller 21 extending in the longitudinal direction is disposed on the lower side of the platen 17 so as to be rotatable.

An endless transportation belt 22 having plural perforation holes (not shown) therein is wound on the driving roller 18, the driven roller 20, and the tension roller 21 so as to surround the platen 17. In this case, the tension roller 21 is biased downward by a spring member (not shown), and the looseness of the transportation belt 22 is suppressed by applying a tension to the transportation belt 22.

Then, if the driving roller 18 is rotationally driven in the clockwise direction when seen from the front side thereof, the transportation belt 22 moves along the outside portions of the driving roller 18, the tension roller 21, and the driven roller 20 when seen from the front side thereof. Further, when the printing sheet 12 is located to face the upper surface of the platen 17, the printing sheet 12 is drawn toward the platen 17 by a suction portion (not shown) over the transportation belt 22, and is transported from the left side as the upstream side to the right side as the downstream side.

Further, a pair of sheet feeding rollers 23 is provided on the obliquely left upper side of the driven roller 20 so as to sequentially feed each of the plurality of printing sheets 12 not subjected to the printing process onto the transportation belt 22. On the other hand, a pair of sheet discharging rollers 24 is provided on the obliquely right upper side of the driving roller 18 so as to discharge each of the printing sheets 12 subjected to the printing process from the transportation belt 22.

Figure 2:
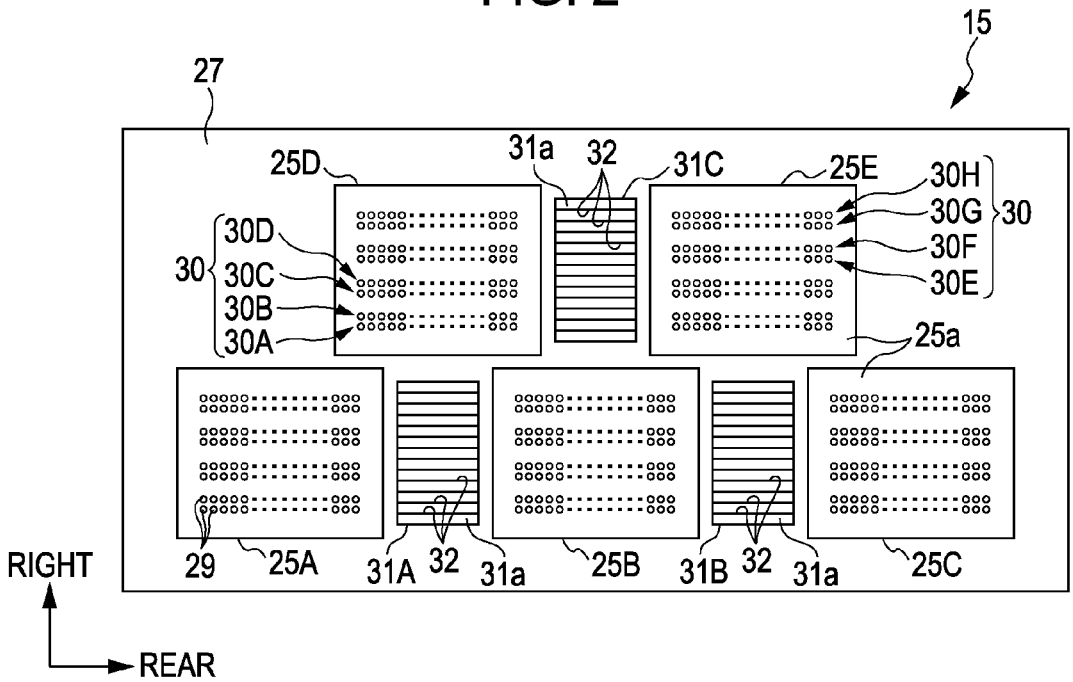
FIG. 2 is a schematic diagram illustrating a nozzle formation surface.

As shown in FIGS. 1 and 2, the printing head unit 15 has a configuration in which plural (in the embodiment, five) printing heads 25 (25A to 25E) as the fluid ejecting heads is disposed in a zigzag pattern in the width direction (the longitudinal direction) of the printing sheet 12 while being retained to a support plate 27. Then, a nozzle formation surface 25*a* formed on each of the lower surfaces of the printing heads 25 is provided with plural rows (in the embodiment, eight rows) of nozzle rows 30 (30A to 30H) which are regularly formed in the longitudinal direction with a predetermined pitch in the horizontal direction by plural nozzles 29. Further, the same kind of ink (fluid) is supplied to each pair of the nozzle rows 30 having the above-described configuration, and the ink is ejected from the nozzles 29.

That is, for example, black ink is supplied to the first and second nozzle rows 30A and 30B. Further, in the same way, cyan ink is supplied to third and fourth nozzle rows 30C and 30D, magenta ink is supplied to fifth and sixth nozzle rows 30E and 30F, and yellow ink is supplied to seventh and eighth nozzle rows 30G and 30H.

Figure 3:
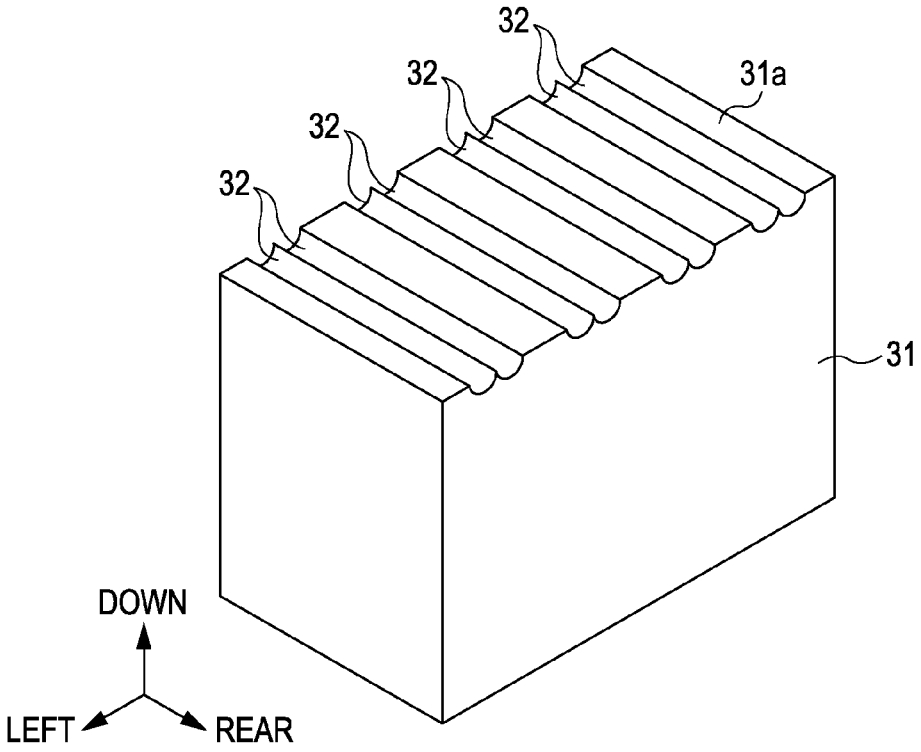
FIG. 3 is a perspective view illustrating a contact member.

Further, as shown in FIGS. 2 and 3, the printing head unit 15 has a configuration in which first to third movable members 31A to 31C as at least one (in the embodiment, three) contact member are supported by the support plate 27 so as to be located between the printing heads 25 in the longitudinal direction. Then, lower surfaces 31*a* of the movable members 31A to 31C are provided with (in the embodiment, eight) concave portions 32 which are formed in numbers equal to the nozzle rows 30 in the longitudinal direction. That is, each of the concave portions 32 is formed in a semi-convex spherical shape in a side view (refer to FIG. 9), and is formed so as to correspond to each of the first to eighth nozzle rows 30A to 30H in the longitudinal direction. Then, each of the movable members 31A to 31C is adapted to be movable in the vertical direction in accordance with a driving of an elevation device 33 (refer to FIG. 4).

Figure 4:
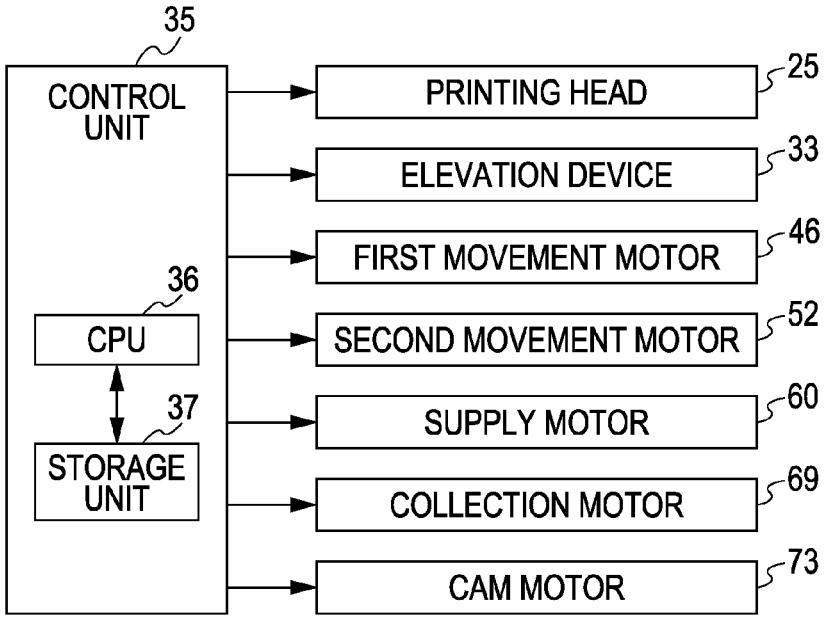
FIG. 4 is a schematic diagram illustrating a control unit.

That is, as shown in FIG. 4, the printer 11 includes a control unit 35 which generally controls the operation state of the printer 11. The control unit 35 is configured as a digital computer that includes a CPU 36 which serves as a central processing unit and conducts various calculations, and a storage unit 37 which stores various programs. Then, the CPU 36 controls the printing heads 25 on the basis of the programs stored in the storage unit 37 so as to control the ejection of the ink from each of the nozzles 29, and controls the driving of the elevation device 33 so as to move the movable members 31A to 31C in the vertical direction.

Figure 5:
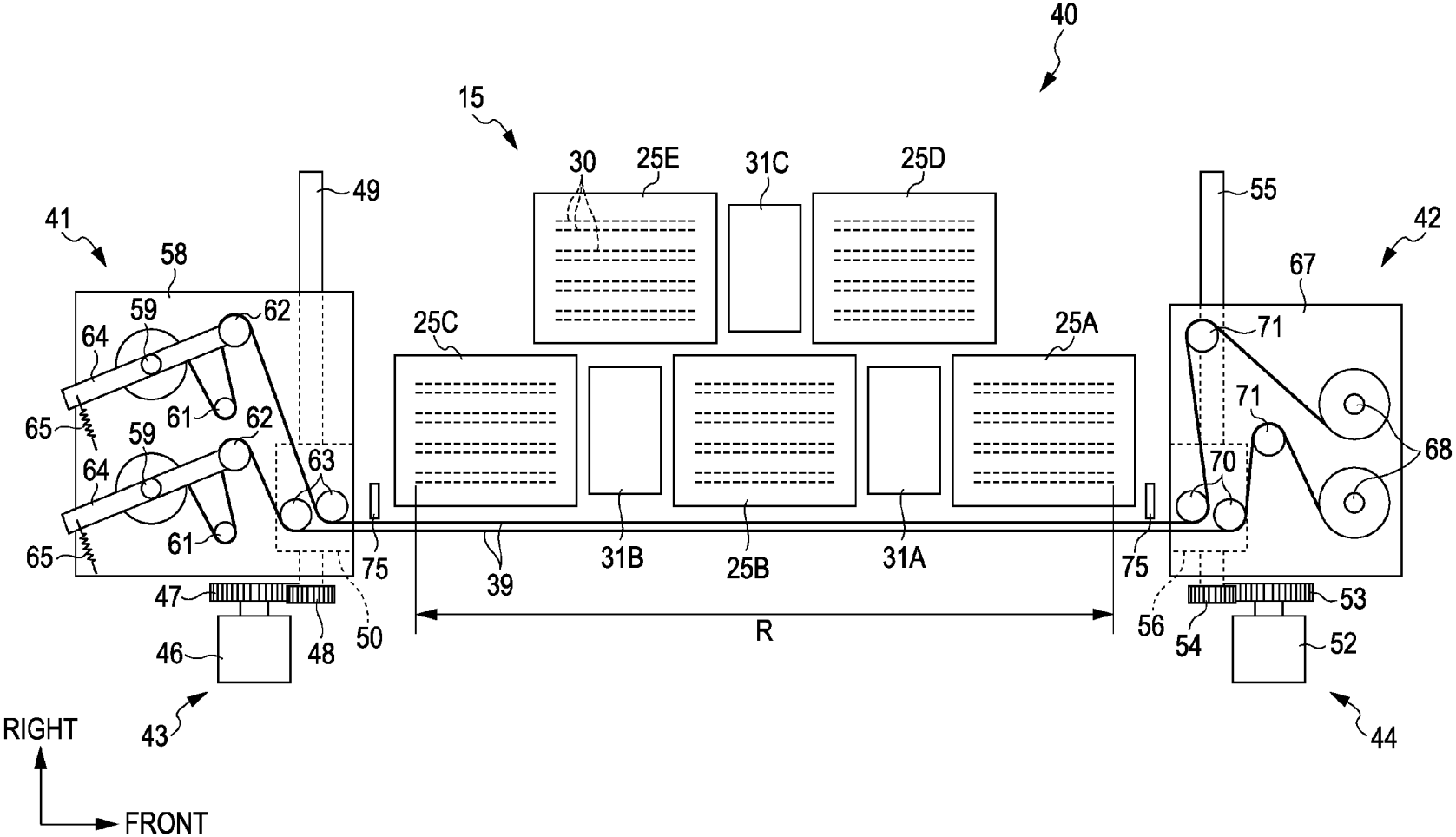
FIG. 5 is a schematic diagram illustrating the flushing unit located at a second position.

Further, as shown in FIG. 5, the printer 11 includes a flushing unit 40 which receives the ink (fluid) ejected from the nozzles 29 in accordance with the flushing process by using a string member 39 as a linear receiving member.

The flushing unit 40 includes a supply portion 41 and a winding portion 42 which are provided with the printing head unit 15 interposed therebetween in the longitudinal direction, and support at least one (in the embodiment, two) string member 39 so as to be detachable therefrom. That is, the supply portion 41 and the winding portion 42 serve as support members that support the string member 39 as the receiving member so as to extend in a linear shape.

Then, the supply portion 41 and the winding portion 42 are adapted to be movable in a reciprocating manner in the horizontal direction by a pair of movement mechanisms 43 and 44 as a support member movement unit. For this reason, the string member 39 having both ends supported by the supply portion 41 and the winding portion 42 is adapted to be movable in a reciprocating manner in the horizontal direction along with the supply portion 41 and the winding portion 42.

The first movement mechanism 43 includes a first driving gear 47 which is rotatable on the basis of the driving force of a first movement motor 46 and a first driven gear 48 which meshes with the first driving gear 47. A male screw is formed on an outer peripheral surface of a first shaft 49 that extends rightward from the center of the first driven gear 48, and a female screw hole formed in a first carriage 50 meshes with the male screw. Then, the supply portion 41 is fixed to the first carriage 50. Therefore, when the first movement motor 46 is driven so as to rotate the first shaft 49, the supply portion 41 moves in a reciprocating manner in the horizontal direction together with the first carriage 50.

In the same way, the second movement mechanism 44 includes a second movement motor 52, a second driving gear 53, a second driven gear 54, a second shaft 55 attached with a male screw, and a second carriage 56 attached with a female screw hole. Then, when the second shaft 55 rotates on the basis of the driving force of the second movement motor 52, the winding portion 42 fixed to the second carriage 56 moves in a reciprocating manner in the horizontal direction.

Here, the supply portion 41 includes a first stage 58 that is fixed to the first carriage 50. Then, a pair of winding shafts 59 is provided on the first stage 58 so as to be rotatable in accordance with the driving of a supply motor 60 (refer to FIG. 4), and first to third rollers 61 to 63 each formed as a pair are rotatably provided on the first stage 58. The string member 39 is rotatably wound on each of the winding shafts 59. Further, the string member 39 is sequentially wound on the first roller 61, the second roller 62, and the third roller 63, and is supplied from the supply portion 41.

Further, the second roller 62 is rotatably supported by a front end side of each of a pair of arms 64 that is tiltable about the center of the winding shaft 59. On the other hand, a tension spring 65 is provided on the rear end side of the arm 64 so as to apply a tensile force to the string member 39.

On the other hand, the winding portion 42 includes a second stage 67 which is fixed to the second carriage 56. Then, a pair of winding shafts 68 is provided on the second stage 67 so as to be rotatable in accordance with the driving of a collection motor 69 (refer to FIG. 4), and fourth and fifth rollers 70 and 71 each formed as a pair are rotatably provided on the second stage 67. Then, the pair of string members 39 supplied from the supply portion 41 are sequentially and respectively wound on the fourth and fifth rollers 70 and 71, and are wound on the winding shafts 68.

Further, the pitch between a pair of third rollers 63 in the horizontal direction and the pitch between a pair of fourth rollers 70 in the horizontal direction are set to be equal to that of the nozzle rows 30 in the horizontal direction. That is, in the embodiment, the pitch between the pair of string members 39 in the horizontal direction is equal to the pitch between the nozzle rows (for example, the first nozzle row 30A and the second nozzle row 30B) ejecting the same ink in the horizontal direction.

Furthermore, the diameter (the thickness) of the string members 39 is set to be smaller than the gap between the nozzle formation surface 25*a* and the printing sheet 12, and to be larger than the diameter of the nozzle 29. That is, for example, when the gap between the printing sheet 12 and the nozzle formation surface 25*a* of the printing head 25 is 2 mm and the diameter of the nozzle 29 is 0.02 mm, it is desirable that the diameter of the string members 39 is set to 0.2 to 1 mm (which is 10 to 50 times the diameter of the nozzle 29). When the diameter of the string members 39 is ten times the diameter of the nozzle 29, the ink can be received in the string members 39 even when the positional precision of the string members 39 and the nozzle 29 and manufacturing errors of the parts are counted in. In addition, when the diameter of the string member 39 is fifty times the diameter of the nozzle 29, the string member 39 can pass through a space area formed between the nozzle formation surface 25*a* and the printing sheet 12.

Further, as shown in FIG. 5, a pair of cam members 75 having a cam surface 74 (refer to FIG. 7) is provided at both sides of the printing head unit 15 so as to be rotatable and to protrude upward or downward in the movement path of the string member 39 in accordance with the driving of a cam motor 73 (refer to FIG. 4). That is, when the cam member 75 is at the first angle (refer to FIG. 7), a cam surface 74 intersects the movement path of the string member 39. When the cam member 75 is at the second angle (refer to FIG. 9), the cam surface 74 does not intersect the movement path of the string member 39.

Then, as shown in FIG. 4, the CPU 36 controls the driving of the first and second movement motors 46 and 52, the supply motor 60, the collection motor 69, and the cam motor 73 on the basis of the program stored in the storage unit 37.

That is, as shown in FIG. 5, when the control unit 35 drives the first and second movement motors 46 and 52 in the normal direction while the supply portion 41 and the winding portion 42 are located on the left side of the printing head unit 15, the supply portion 41 and the winding portion 42 move in the right direction so as to be located at the first position.

Figure 6:
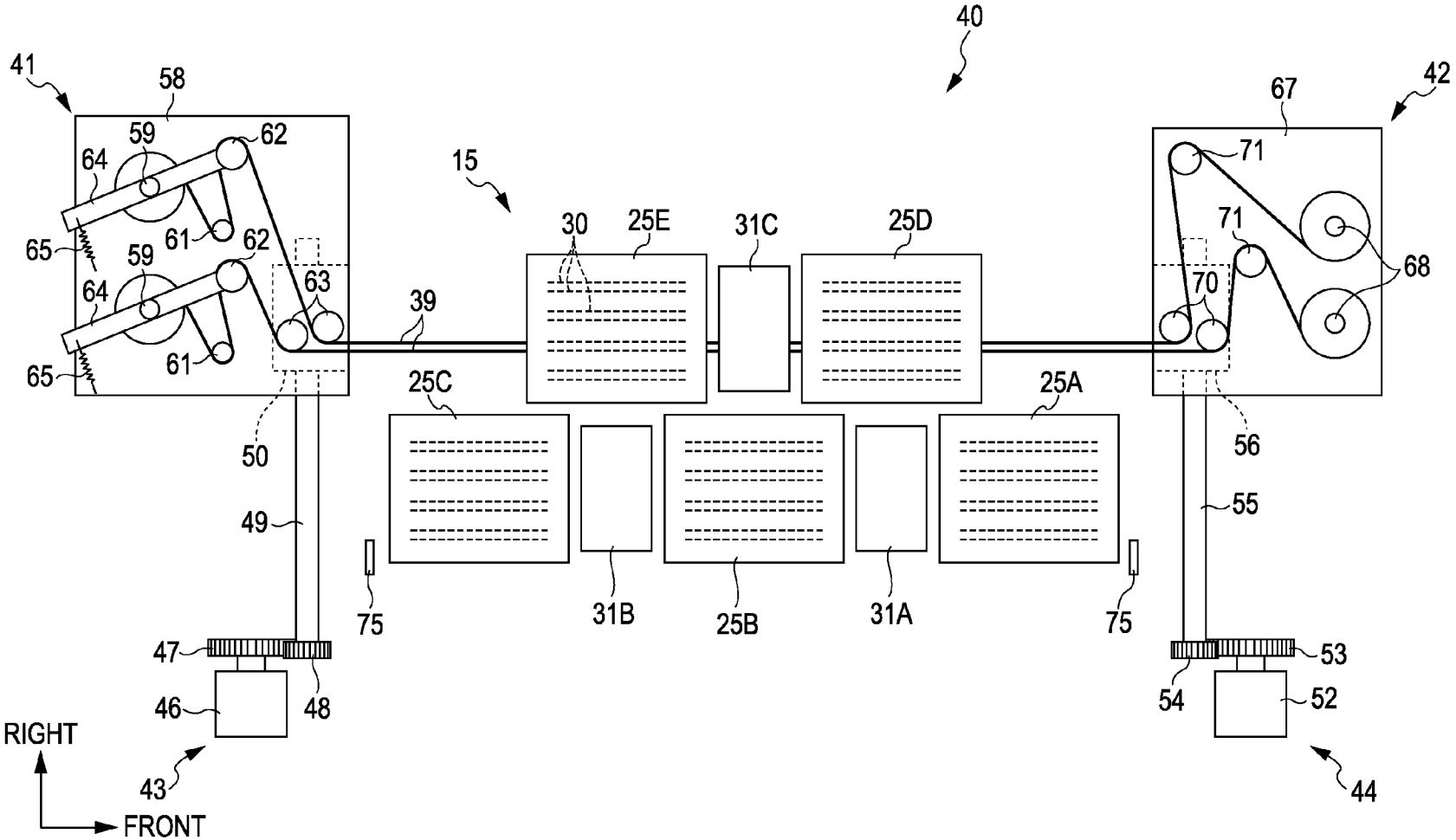
FIG. 6 is a schematic diagram illustrating the flushing unit located at the first position.

Further, as shown in FIG. 6, the first position indicates a position in which each of the string members 39 faces each of the nozzle rows 30 in the vertical direction. That is, when the supply portion 41 and the winding portion 42 are located at the first position, the string members 39 are located at a position capable of receiving the ink ejected from the nozzle 29. Further, the first position and the receiving position are set in accordance with the number of the nozzle rows 30 and the string members 39, and in the embodiment, are set to eight positions (the number of the nozzle rows 30 located at different positions in the horizontal direction is divided by the number of the string members 39).

Figure 7:
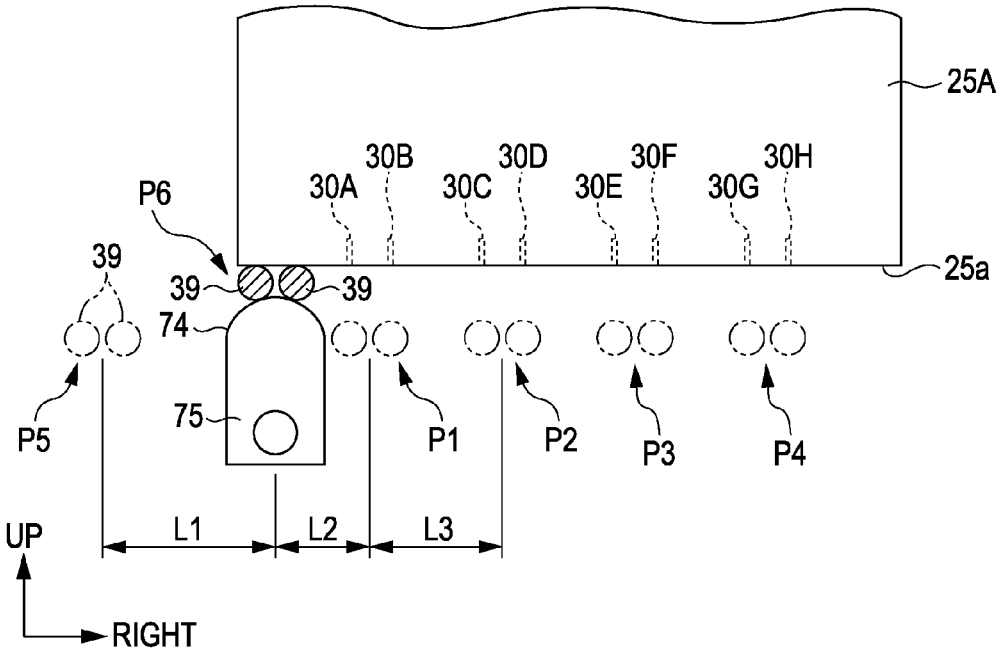
FIG. 7 is a front schematic diagram illustrating a case where a string member comes into contact with a nozzle formation surface.

Specifically, as shown in FIG. 7, the position which is depicted by the two-dot dashed line and in which the string members respectively face the first and second nozzle rows 30A and 30B of the first to third printing heads 25A to 25C disposed on the left side of the printing head unit 15 is set to a first receiving position P1. In the same way, the position in which the string members respectively face the third and fourth nozzle rows 30C and 30D is set to a second receiving position P2; the position in which the string members respectively face the fifth and sixth nozzle rows 30E and 30F is set to a third receiving position P3; and the position in which the string members respectively face the seventh and eighth nozzle rows 30G and 30H is set to a fourth receiving position P4.

Further, the positions in which the string members respectively face the first to eighth nozzle rows 30A to 30H of the fourth and fifth printing heads 25D and 25E disposed on the right side of the printing head 15 are set to fifth to eighth receiving positions (not shown). FIG. 6 shows a state in which the string members 39 are located at the sixth receiving position.

Then, when the control unit 35 drives the first and second movement motors 46 and 52 in the reverse direction while the supply portion 41 and the winding portion 42 are located at the first position, the supply portion 41 and the winding portion 42 move in the left direction so as to be located at the second position. Further, the second position indicates a position in which the string members 39 do not face the nozzle rows 30 in the vertical direction as shown in FIG. 5. That is, when the supply portion 41 and the winding portion 42 are located at the second position, the string members 39 are located at a retreat position P5 (refer to FIG. 7) that deviates from the first to fourth receiving positions P1 to P4 and the fifth to eighth receiving positions.

Next, the operation of the printer 11 with the above-described configuration and particularly the operation during the flushing process will be described below. Further, the supply portion 41 and the winding portion 42 are located at the second position at a timing other than the flushing process. That is, the string member 39 is located at the retreat position P5 at the timing other than the flushing process. Further, the rotation angle of the cam member 75 is set to the first angle at which the cam surface 74 is located at a position intersecting the movement path of the string member 39.

Here, when the printing process starts in the printer 11, the control unit 35 creates an ink ejecting timing for each of the nozzles 29 on the basis of the printing data, and ejects the ink on the basis of the ejection timing. Then, the printing process is performed on the printing sheet 12 supported and transported by the transportation belt 22.

However, when the period during which the ink is not ejected from the nozzle 29 is long, the viscosity inside the nozzle 29 increases, which raises concerns that ejection errors may occur. Therefore, the control unit 35 performs the flushing process, in which the ink is ejected at an ejection timing different from the timing of the printing process, every predetermined interval.

Specifically, the control unit 35 drives the first and second movement motors 46 and 52 in the normal direction so as to move the supply portion 41 and the winding portion 42 in the right direction. Then, the string members 39 supported by the supply portion 41 and the winding portion 42 also move in the right direction.

Figure 8:
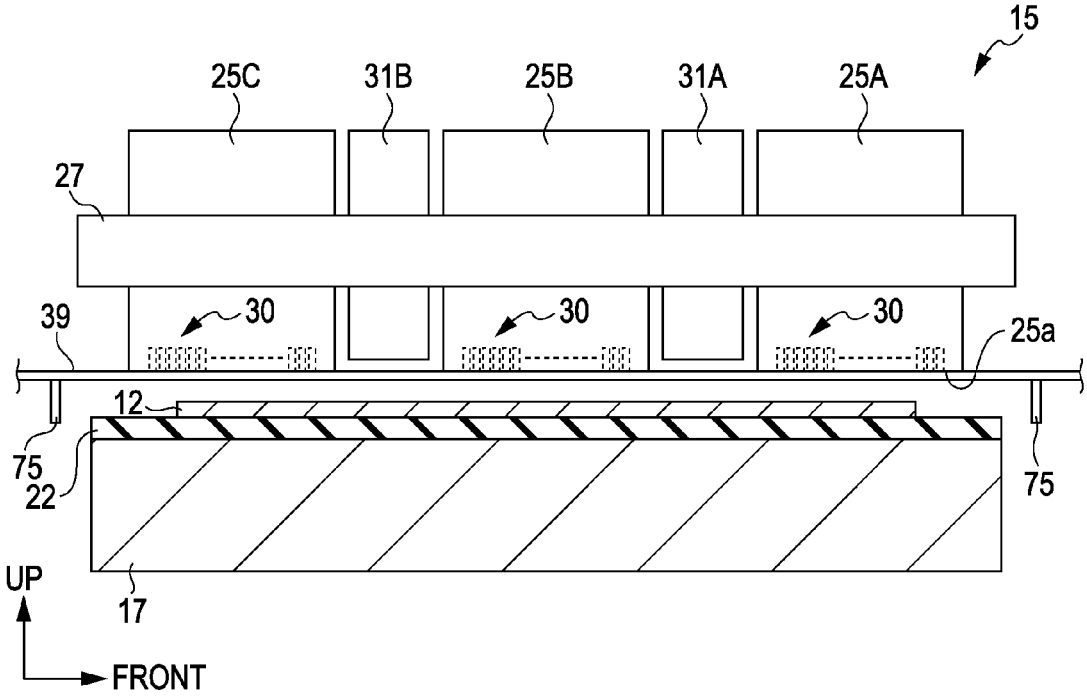
FIG. 8 is a side schematic diagram illustrating a case where the string member comes into contact with the nozzle formation surface.

At this time, since the cam member 75 is at the first angle as shown in FIGS. 7 and 8, the movement path of the string members 39 intersect the cam surface 74. For this reason, the string members 39 move on the slope surface of the cam surface 74 so as to relatively move in the vertical direction intersecting the longitudinal direction in which the string members 39 extend, and to come into contact with the nozzle formation surfaces 25*a* of the first to third printing heads 25A to 25C. That is, in the string members 39, a receiving area R (refer to FIG. 5) corresponding to an area provided with the nozzle row 30 in the longitudinal direction and facing the nozzle row 30 to receive the ink comes into contact with the nozzle formation surface 25*a*. For this reason, the printing head 25 serves as a fixation member and a contact member, and the cam member 75 serves as a movement direction changing unit. Further, even when the string members 39 move on the cam surface 74 so as to change the movement path thereof, since the second roller 62 biased by the tension spring 65 displaces, it is possible to reduce concerns that excessive tensile force may applied to the string members 39.

Then, as shown in FIG. 7, in the contact position P6 where the string members 39, of which the movement directions are changed by the cam member 75, come into contact with the nozzle formation surface 25*a*, the distance L2 between the contact position P6 and the first receiving position P1 is set to be shorter than the distance L1 between the contact position P6 and the retreat position P5.

Subsequently, the control unit 35 locates the supply portion 41 and the winding portion 42 at the first position by stopping the driving of the first and second movement motors 46 and 52 so that the string members 39 are located at the first receiving position P1 corresponding to the first and second nozzle rows 30A and 30B subjected to the flushing process. In addition, the control unit 35 rotates the cam member 75 to the second angle by driving the cam motor 73. Then, the cam surface 74 retreats to the position not intersecting the movement paths of the string members 39.

Figure 9:
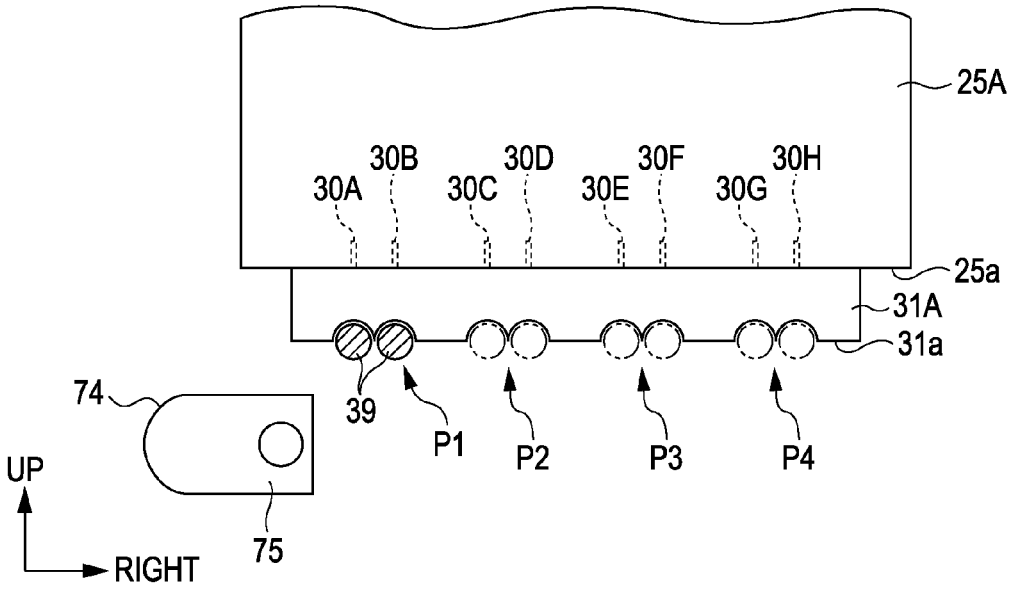
FIG. 9 is a front schematic diagram illustrating a case where the string member comes into contact with a movable member.
Figure 10:
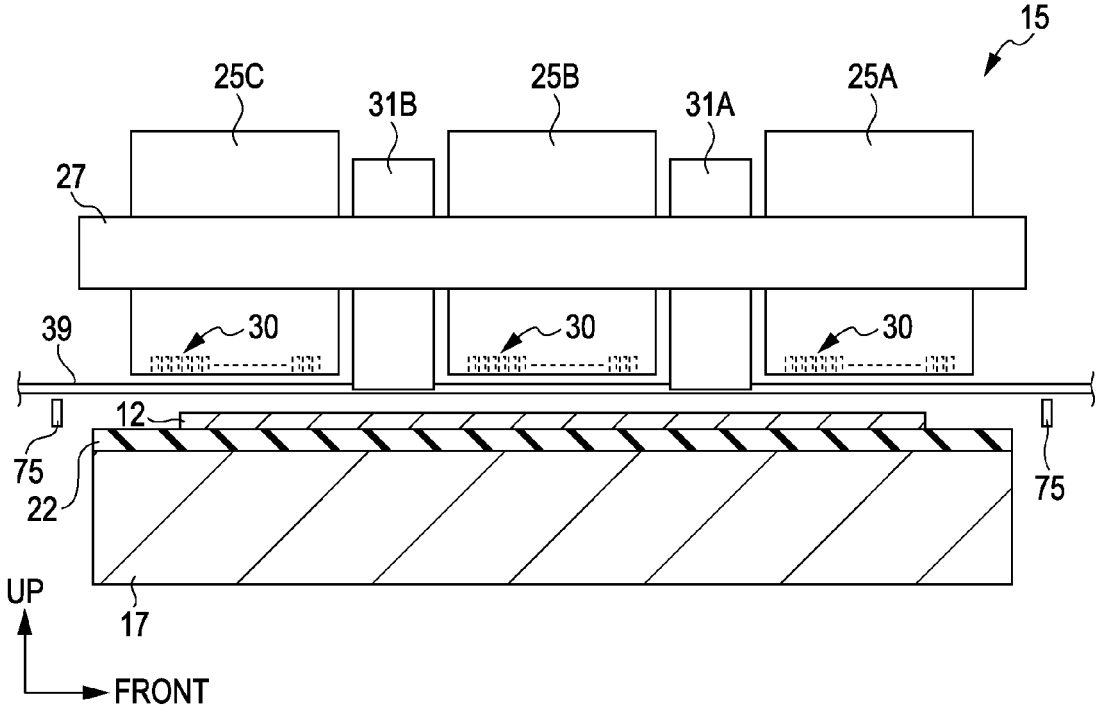
FIG. 10 is a side schematic diagram illustrating a case where the string member comes into contact with the movable member.

In addition, the control unit 35 controls the driving of the elevation device 33 so as to move down the movable members 31A to 31C and to relatively move the string members 39 in the vertical direction intersecting the longitudinal direction in which the string members 39 extend. Then, as shown in FIGS. 9 and 10, the concave portions 32 formed on the lower surfaces 31*a* of the first and second movable members 31A and 31B come into contact with the string members 39 located at the first receiving position P1. That is, since the movable members 31A to 31C provided between the printing heads 25 come into contact with the string members 39, the movable members come into contact with the receiving area R located at the center portion of the string member 39 having both ends supported by the supply portion 41 and the winding portion 42. In addition, when the first and second movable members 31A and 31B come into contact with the string members 39 at the first receiving position P1, the contact position P6 and the first receiving position P1 are located at the same position. For this reason, the distance between the contact position P6 and the first receiving position P1 is shorter than the distance between the contact position P6 and the retreat position P5.

Further, the control unit 35 controls the printing head 25 so as to eject the ink from the first and second nozzle rows 30A and 30B. In addition, since the string members 39 come into contact with the nozzle formation surface 25*a* before reaching the first receiving position P1, the vibration thereof is suppressed. Also, since the string members 39 come into contact with the movable members 31A to 31C after reaching the first receiving position P1, the vibration thereof is attenuated. For this reason, the ink ejected from the first and second nozzle rows 30A and 30B is received in the string members 39 located below the first and second nozzle rows 30A and 30B.

Subsequently, the control unit 35 controls the driving of the elevation device 33 so as to move up the movable members 31A to 31C, and drives the first and second movement motors 46 and 52 in the reverse direction so as to move the supply portion 41 and the winding portion 42 located at the first position in the left direction and to move the supply portion 41 and the winding portion 42 to the second position. For this reason, the string members 39 located at the first receiving position P1 move to the retreat position P5. In addition, since the cam member 75 is at the second angle at this time, the cam surface 74 retreats from the movement paths of the string members 39. Accordingly, the string members 39 move to the retreat position while the movement direction is not changed. When the string members 39 move and stop at the retreat position P5, the string members 39 vibrate, but since the ink is not received in the string members locate at the retreat position P5, no particular problem arises even when the string members vibrate. Then, the control unit 35 drives the supply motor 60 and the collection motor 69 so as to wind the receiving area R of the string members 39 receiving the ink therein on the winding shaft 68, and to supply the new receiving area R of the string members 39 from the winding shaft 59.

In addition, when the flushing process is performed on all nozzle rows 30, the control unit 35 further drives the first and second movement motors 46 and 52 in the normal direction from the state where the string members 39 are located at the first receiving position P1, and moves the string members 39 to the second receiving position P2. In addition, the control unit 35 controls the driving of the elevation device 33 so as to move down the movable members 31A to 31C, and to allow the string members 39 to come into contact with the first and second movable members 31A and 31B. Then, the control unit 35 controls the first to third printing heads 25A to 25C so as to eject the ink from the third and fourth nozzle rows 30C and 30D. Then, the ink is receive in the string members 39 located below the third and fourth nozzle rows 30C and 30D while the vibration thereof is suppressed. Subsequently, the movable members 31A to 31C are moved up.

In the same way, the control unit 35 controls the first and second movement motors 46 and 52 so as to sequentially locate the string members 39 to the third and fourth receiving positions P3 and P4 and the fifth to eighth receiving positions, and controls the driving of the elevation device 33 so as to allow the movable members 31A to 31C to come into contact with the string members. Then, the control unit 35 performs the flushing process by controlling the printing head 25 and ejecting the ink from the nozzle rows 30 facing the string members 39.

Then, when the flushing process is performed on all nozzle rows 30, the control unit 35 drives the first and second movement motors 46 and 52 in the reverse direction so as to move the supply portion 41 and the winding portion 42 to the second position, and to locate the string members 39 at the retreat position P5.

According to the above-described embodiment, it is possible to obtain the following advantages.

(1) When the supply portion 41 and the winding portion 42 moving from the second position toward the first position stops at the first position, the string members 39 supported by the supply portion 41 and the winding portion 42 may be vibrated at the receiving position due to the restoration force of the string members 39 and the inertia force in the movement direction. For this reason, when the string members 39 move to the first receiving position P1 in accordance with the movement of the supply portion 41 and the winding portion 42 from the second position to the first position, since the string members come into contact with the first and second movable members 31A and 31B and the printing head 25, it is possible to suppress the vibration of the string members at the first receiving position P1. Accordingly, even when the string members 39 move and stop at the receiving position capable of receiving the ink ejected from the nozzles 29, it is possible to rapidly and easily receive the ink ejected from the nozzles 29 by the use of the string members 39.

(2) The vibration of the string members 39 is large when the string members move fast compared with the case where the string members move slowly. For this reason, even when the string members move fast the long distance from the retreat position P5 to the contact position P6, since the string members 39 come into contact with the movable members 31A to 31C and the printing head 25 at the contact position P6, it is possible to suppress the vibration thereof. Accordingly, it is possible to rapidly move the string members from the retreat position P5 to the first receiving position P1 while suppressing the vibration of the string members 39.

(3) Since the string members 39 come into contact with the printing head 25 before reaching the first receiving position P1, it is possible to allow the string members 39 to reach the first receiving position P1 while suppressing the vibration of the string members 39. In addition, since the string members 39 come into contact with the movable members 31A to 31C after reaching the first receiving position P1, it is possible to attenuate the vibration of the string members 39 located at the first receiving position P1. Accordingly, it is possible to rapidly eject the ink toward the string members 39 reaching the first receiving position P1.

(4) Since the movement directions of the string members 39 are changed by the cam member 75 and the string members 39 come into contact with the printing head 25, it is possible to suppress the vibration of the string members 39. In addition, since the movable members 31A to 31C move to come into contact with the string members 39, it is possible to suppress the vibration of the string members 39.

(5) When the supply portion 41 and the winding portion 42 move, the movement directions of the string members 39 are changed along the cam surface 74. For this reason, it is possible to allow the string members 39 to come into contact with the printing head 25 by easily changing the movement directions of the string members 39.

(6) Since it is possible to allow the string members 39 to come into contact with the movable members 31A to 31C after the string members 39 stop at the first receiving position P1, it is possible to attenuate the vibration of the string members 39.

(7) Since the movable members 31A to 31C move so as to protrude upward and downward in the movement paths of the string members 39, it is possible to suppress the vibration of the string members 39 by allowing the string members 39 to come into contact with the movable members 31A to 31C. Further, when the string members 39 receiving the ink at the first receiving position P1 moves to the retreat position P5, since the movable members 31A to 31C move to a position not intersecting the movement paths of the string members 39, the contact between the string members 39 and the movable members 31A to 31C is suppressed, which may reduce concerns that the ink may become attached to the movable members 31A to 31C.

(8) Since the cam surface 74 is disposed so as to protrude upward and downward in the movement paths of the string members 39, it is possible to change the movement paths of the string members 39. That is, for example, when the string members 39 move from the retreat position P5 to the first receiving position P1, the cam member 75 is allowed to be at the first angle so that the cam surface 74 is located at a position intersecting the movement paths of the string members 39. Then, the movement directions of the string members 39 are changed, so that the string members 39 come into contact with the printing head 25. On the other hand, when the string members 39 move from the first receiving position P1 to the retreat position P5, the cam member 75 is allowed to be at the second angle so that the cam surface 74 is located at a position not intersecting the movement path of the string member 39. Then, it is possible to move the string members 39 to the retreat position P5 without contacting the printing head 25. Accordingly, when the string members 39 move from the retreat position P5 to the first receiving position P1, it is possible to suppress the vibration of the string members by allowing the string members to come into contact with the printing head 25. In addition, when the string members 39 receiving the ink at the first receiving position P1 moves to the retreat position P5, the string members are suppress from coming into contact with the cam surface 74, which may reduce concerns that the ink may become attached to the cam surface 74.

(9) The amplitude generated when the string members 39 are vibrated increases as the distance from the supply portion 41 and the winding portion 42 increases. For this reason, since the printing head 25 and the movable members 31A to 31C come into contact with the receiving area R of the string member 39, the printing head and the movable members come into contact with the vicinity of the center of the string members 39, where the amplitude is large at the center of the string member 39. Accordingly, it is possible to efficiently attenuate the vibration of the string members 39.

(10) Since the portions of the movable members 31A to 31C coming into contact with the string members 39 are provided with the concave portions 32, the contact area of the string members 39 is large compared with the case where the string members come into contact with a plane portion. Accordingly, it is possible to improve the effect of attenuating the vibration in such a manner that the string members 39 come into contact with the concave portions 32. Further, even when the stop positions of the string members 39 deviate, the string members 39 coming into contact with the movable members 31A to 31C move along the concave portions 32 so as to face the nozzle rows 30. Accordingly, it is possible to locate the string members 39 at the receiving position even when the precision of the first and second movement motors 46 and 52 is insufficient.

(11) Since the string members 39 move in the space area formed between the nozzle formation surface 25*a* and the printing sheet 12, it is possible to perform the flushing process regardless of the transportation timing of the printing sheet 12. In addition, it is possible to perform the flushing process even when the printing process is performed on the continuous and elongated sheet continuously supplied.

Further, the above-described embodiment may be modified as below.

A cleaning mechanism may be provided so as to clean the string members 39 receiving the ink therein, and the flushing process may be performed by again supplying the string members 39 wound on the winding portion 42 toward the supply portion 41.

The retreat position P5 of the string members 39 may be set to the lower side of the transportation path of the printing sheet 12 at a position facing the nozzle formation surface 25*a* of the printing head 25 in the vertical direction. That is, since the ink ejected from the nozzles 29 has the form of mist, when the string members 39 are located to be away from the nozzle formation surface 25*a*, the string members cannot receive the ink even when facing the nozzle rows 30. For this reason, the string members 39 may move between the retreat position on the lower side of the transportation path of the printing sheet 12 and the receiving position on the upper side of the transportation path of the printing sheet 12. In addition, as a printer capable of disposing the string members 39 at a position on the lower side of the transportation path of the printing sheet 12, for example, the printing sheet 12 may be transported by the sheet feeding roller 23 and the sheet discharging roller 24 without using the transportation belt 22. Further, the string members 39 may be received by forming a receiving opening or a receiving hole in the transportation belt 22 or the platen 17. In addition, the string members 39 may not be provided throughout the longitudinal direction of the printing head unit 15, and for example, may be provided to have a width corresponding to each of the printing heads 25.

At least one of the movable members 31A to 31C and the cam member 75 may be provided. That is, when the string members 39 move from the retreat position P5 to the receiving position, if the string members come into contact with at least one of the movable members 31A to 31C and the printing head 25, it is possible to suppress the vibration of the string members 39 located at the receiving position. Since the movement distance to the receiving position P1 while the string members 39 come into contact with the printing head 25 is short, even when the string members 39 move while being vibrated, the amplitude is small, and no problem receiving the ink arises.

The control unit 35 may control the elevation device 33 so as to allow the movable members 31A to 31C to come into contact with the string members 39 only when the string members move from the retreat position P5 to the receiving position P1, and may allow the movable members 31A to 31C not to come into contact with the string members 39 between the receiving positions. That is, the string members 39 are located at the receiving position while coming into contact with the printing head 25 or the movable members 31A to 31C to suppress the vibration thereof. In addition, since the distance L3 (refer to FIG. 7) between the receiving positions is shorter than the distance L1 between the retreat position P5 and the contact position P6, even when the string members 39 move between the receiving positions while being vibrated, the amplitude is small, and the vibration is rapidly attenuated compared with the case where the string members move from the retreat position P5 to the receiving position.

The movable members 31A to 31C may be adapted to be movable in the vertical direction for each of the nozzle rows 30 or by the unit of the flushing process (for example, two rows). In addition, the movable members 31A to 31C may be provided so as to correspond to at least one nozzle row 30. That is, for example, the movable members 31A to 31C may be adapted to be movable while being fixed to at least one of the supply portion 41 and the winding portion 42.

The plane portion may come into contact with the string members 39 without forming the concave portions 32 in the movable members 31A to 31C. Further, the shape of the concave portion 32 may be arbitrarily changed to a U-shape, a V-shape, and the like in the side view thereof, but the vibration attenuation effect can be improved as the contact area with the string members 39 increases. In addition, the contact portion contacting the string members 39 may be formed so as to protrude from the lower surface 31*a*.

When the movable members 31A to 31C are able to be switched between the contact state and the non-contact state against the string members 39, it is possible to move the string members to an arbitrary direction in the vertical, horizontal, and longitudinal directions.

When a plurality of cam members 75 is provided, the contact position P6 may be changed in accordance with the nozzle rows 30 subjected to the flushing process.

The cam member 75 may change the movement path of the string member 39 downward, and allow the string members 39 to come into contact with the printing sheet 12 or the transportation belt 22. That is, since the slope surface changing the movement paths of the string members 39 is formed as the cam surface 74, the path where the string members 39 move from the retreat position P5 to the receiving position may be set to be different from the path where the string members 39 move from the receiving position to the retreat position P5. Accordingly, since the movement direction of the clean string member 39 to be used to receive the ink therein is changed downward so that the string members 39 come into contact with the printing sheet 12 or the transportation belt 22, it is possible to locate the string members 39 at the receiving position while suppressing the vibration of the string members 39. In addition, when the string members 39 move from the receiving position to the retreat position P5, since the cam surface 74 retreats to a position not intersecting the movement paths of the string members 39, it is possible to reduce concerns that the string members 39 having the ink attached thereto may contaminate the printing sheet 12 and the transportation belt 22.

The string members 39 may come into contact with a contact member in an area other than the receiving area R on the side of the supply portion 41 or the winding portion 42 rather than the printing head 25 in the direction where the string members 39 extend. That is, even when the cam member 75 serves as a contact member, it is possible to suppress the vibration of the string members 39. Further, the cam member 75 may be provided at a position between the printing heads 25.

The string members 39 may come into contact with the supply portion 41 and the winding portion 42 while moving the supply portion 41 and the winding portion 42 in the vertical direction. That is, in the above-described embodiment, the movement directions of the string members 39 are changed in such a manner that the cam member 75 comes into contact with the string members 39. However, for example, the cam member 75 may be provided below the supply portion 41 and the winding portion 42 so as to move in the vertical direction for each of the flushing units 40.

A convex portion may be formed in the nozzle formation surface 25*a* of the printing head 25 so as to intersect the movement paths of the string members 39, and the string members 39 may come into contact with the convex portion in accordance with the movement of the string members 39.

The movable members 31A to 31C may be provided at a position between the retreat position P5 and the receiving position, and may come into contact with the string members 39 during the movement thereof.

The cam member 75 may come into contact with the string members 39 stopping at the receiving position to change the positions of the string members 39, and to come into contact with the printing head 25.

The movement direction changing unit may be formed as a plate member or a bar member of which at least one surface is fixed so as to obliquely intersect the movement paths of the string members 39.

The string members 39 may be provided by a length corresponding to the receiving area R, and may be supported by a support member not having the supply and winding functions so as to be movable in the horizontal direction.

The supply portion 41 and the winding portion 42 may be disposed in a fixed manner, and the third roller 63 and the fourth roller 70 may be adapted to be movable in the horizontal direction. That is, when the third roller 63 and the fourth roller 70 move in the right direction, the string members 39 also moves in the right direction together with the third roller 63 and the fourth roller 70. Further, it is desirable that the rotation of the supply motor 60 or the collection motor 69 is controlled in addition to the control of the third roller 63 and the fourth roller 70. That is, since the rotation of the supply motor 60 and the collection motor 69 is controlled, the tensile force is adjusted. Also, it is possible to suppress concerns that the string members 39 may move away from the third roller 63 and the fourth roller 70, and to suppress concerns that the string members 39 may be damaged due to excessive tensile force. In this case, the third roller 63 and the fourth roller 70 serve as a support member. Further, as a support member movement mechanism for moving the third and fourth rollers 63 and 70, the supply portion 41, and the winding portion 42, a rack-and-pinion, a solenoid, a cam mechanism, and the like may be used.

The string members 39 may be formed of fiber such as silk or cotton, synthetic fiber such as polyamide (for example, nylon) or polyester, and metal such as stainless steel. That is, the string member may be formed of fiber such as PBO (poly-phenylene-benzobisoxazole, product name: Zylon), polyarylate, ultrahigh molecular weight polyethylene, aramid, or nylon applied with a hydrophobic coating, or compound fiber containing a plurality of these. More specifically, it is possible to form the string members 39 in such a manner that plural fiber bundles formed of the fiber or the compound fiber are twisted or bound. Then, when the string members 39 are formed by twisting the plural fiber bundles, it is possible to hold the ink even between the fiber bundles, and thus to increase the ink receiving amount. Further, the string members 39 may be formed of an elastic member such as rubber having excellent elasticity, and may be formed to have elasticity by forming the string member in, for example, a spiral shape. Further, the string members 39 may absorb the attached ink between the fibers, and also may receive the ink by surface tension or electrostatic force.

In the printing head unit 15, the plural printing heads 25 may not be arranged in a zigzag pattern, but one printing head may be provided to have a length corresponding to the width direction of the printing sheet 12. Further, the printer 11 is not limited to the line type, but may be a serial type printer or a lateral type printer equipped with the movable printing head 25. That is, the flushing process may be performed by moving the printing head 25 to the position of the flushing unit 40.

In the above-described embodiment, the fluid ejecting apparatus is embodied as the ink jet printer 11, but the invention may be applied to a fluid ejecting apparatus that ejects a fluid different from the ink. The invention may be applied to various fluid ejecting apparatuses that include a fluid ejecting head ejecting a minute amount of liquid droplets. In addition, the liquid droplets represent the fluid ejected from the fluid ejecting apparatus, and include a liquid having a particle shape, a tear shape, or a linear shape. Further, here, the fluid may be a material which can be ejected from the liquid ejecting apparatus. For example, the material may be in a liquid or gas state, and includes a liquid material such as sol or gel water having a high or low viscosity, a fluid material such as an inorganic solvent, an organic solvent, a liquid, a liquid resin, or liquid metal (metallic melt), and a material in which particles of a functional material having a solid material such as pigment or metal particles are dissolved, dispersed, or mixed with a solvent in addition to a fluid. In addition, ink or liquid crystals described in the above-described embodiment may be exemplified as a typical example of the fluid. Here, the ink indicates general water-based ink, oil-based ink, gel ink, or hot-melt ink which contains various fluid compositions. As a detailed example of the fluid ejecting apparatus, for example, a liquid crystal display, an EL (electro-luminance) display, a plane-emission display, a fluid ejecting apparatus for ejecting a fluid containing dispersed or melted materials such as an electrode material or a color material used to manufacture a color filter, a fluid ejecting apparatus for ejecting a biological organic material used to manufacture a biochip, a fluid ejecting apparatus for ejecting a fluid as a sample used as a precise pipette, a silkscreen printing apparatus, or a micro dispenser may be used. In addition, a fluid ejecting apparatus for ejecting lubricant from a pinpoint to a precise machine such as a watch or a camera, a fluid ejecting apparatus for ejecting a transparent resin liquid such as a UV-curing resin onto a substrate in order to form a minute hemispherical lens (optical lens) used for an optical transmission element or the like, or a fluid ejecting apparatus for ejecting an etching liquid such as an acid liquid or an alkali liquid in order to perform etching on a substrate or the like may be adopted. Further, the invention may be applied to any one of these fluid ejecting apparatuses.

Next, the technical concepts obtained from the above-described embodiment and the modified example will be described below.

(A) The fluid ejecting apparatus according to Aspect 5, wherein the slope surface is a cam surface provided on a rotatable cam member.

According to this configuration, since the slope surface is disposed so as to protrude upward and downward in the movement path of the receiving member, it is possible to change the movement path of the receiving member. That is, for example, when the receiving member moves from the retreat position to the receiving position, the slope surface may be located at the position intersecting the movement path, thereby changing the movement direction of the receiving member and allowing the receiving member to come into contact with the contact member. On the other hand, when the receiving member moves from the receiving position to the retreat position, the slope surface is located at a position not intersecting the movement path, thereby moving the receiving member to the retreat position without coming into contact with the contact member. Accordingly, when the receiving member moves from the retreat position to the receiving position, it is possible to suppress the vibration of the receiving member in such a manner that the receiving member comes into contact with the contact member. Further, when the receiving member receiving the fluid at the receiving position moves to the retreat position, it is possible to suppress concerns that the fluid may become attached to the cam surface by suppressing the receiving member from contacting the cam surface.

(B) The fluid ejecting apparatus according to any one of Aspects 1 to 7 and the technical concept (A), wherein the contact member faces the nozzles so as to come into contact with the receiving area of the receiving member capable of receiving the fluid therein when the receiving member is located at the receiving position.

The amplitude generated when vibrating the receiving member increases as the distance from the support member increases. For this reason, according to this configuration, since the contact member comes into contact with the receiving area of the receiving member, the contact member comes into contact with the vicinity of the center of the receiving member, where the amplitude is large at the center of the receiving member. Accordingly, it is possible to efficiently attenuate the vibration of the receiving member.

The entire disclosure of Japanese Patent Application No. 2009-295640, filed Dec. 25, 2009 is expressly incorporated by reference herein.

What is claimed is:

1. A fluid ejecting apparatus comprising:

a plurality of fluid ejecting heads which include a nozzle row formed of a plurality of nozzles ejecting a fluid;

a receiving member which is capable of receiving the fluid ejected from the nozzles and operable to extend along the nozzle rows of the plurality of ejecting heads;

a pair of support members which support the receiving member so as to extend along the nozzle row;

a support member movement unit which moves the pair of support members between first and second positions so that the receiving member is located at a receiving position capable of receiving the fluid ejected from the nozzles at the first position, and the receiving member is located at a retreat position deviating from the receiving position at the second position; and a plurality of contact members provided in between the pair of support members and provided in between the plurality of ejection heads in an offset manner, the contact members coming into contact with the receiving member while intersecting the extension direction of the receiving member relative to the receiving member supported by the pair of support members to extend along the nozzle rows when the support member movement unit moves the support member from the second position to the first position, wherein the plurality of contact members are configured as vibration suppressing members that suppresses vibration of the receiving member as the receiving member moves from the receiving position to the retreat position, and include one or more concave portions formed in a longitudinal direction, wherein the plurality of nozzles eject the fluid to the receiving member, when the contact member contacts with the receiving member.

2. The fluid ejecting apparatus according to claim 1, wherein a distance between the receiving position and a contact position in which the receiving member comes into contact with the contact member is shorter than a distance between the retreat position and the contact position.

3. The fluid ejecting apparatus according to claim 1, wherein the contact member comes into contact with the receiving member at least one of before and after the receiving member reaches the receiving position.

4. The fluid ejecting apparatus according to claim 1, wherein the contact member is formed as at least one of a fixation member which is immovably fixed relative to the receiving member or a movable member which is movably disposed so as to protrude upward and downward in the movement path of the receiving member, and wherein when the contact member is formed as the fixation member, the fluid ejecting apparatus further includes a movement direction changing unit which changes the movement direction of the receiving member toward the fixation member while the receiving member moves from the retreat position toward the receiving position.

5. The fluid ejecting apparatus according to claim 4, wherein the movement direction changing unit includes a slope surface which intersects a movement path of the receiving member.

6. The fluid ejecting apparatus according to claim 4, wherein the contact member comes into contact with the receiving member at the receiving position.

7. The fluid ejecting apparatus according to claim 4, wherein the contact member is the movable member which provided so as to protrude upward and downward in a movement path of the receiving member.

8. The fluid ejecting apparatus according to claim 1, wherein the contact member moves in a direction of which the plurality of nozzles eject the fluid when the support member movement unit moves the pair of support members from the second position to the first position.

9. The fluid ejecting apparatus according to claim 1, wherein the receiving member faces the nozzle row in the state where the receiving member is alienated from the nozzle row in a predetermined distance, when the support member movement unit moves the pair of support members from the second position to the first position.

10. The fluid ejecting apparatus according to claim 1, wherein the receiving member is located at the first position, when a flushing process for maintaining a ejecting performance of the plurality of nozzles is performed.

* * * * *